United States Patent [19]

Katz

[11] 4,279,415

[45] Jul. 21, 1981

[54] EXERCISING DEVICE

[76] Inventor: Sam Katz, 530-D Grant St., New York, N.Y. 10002

[21] Appl. No.: 53,707

[22] Filed: Jun. 29, 1979

[51] Int. Cl.[3] ..... A63B 23/04

[52] U.S. Cl. ..... 272/70; 272/141

[58] Field of Search ..... 227/120; 272/70, 141, 272/96, 69, 66, 68; 5/475, 477; 128/25 B; 35/29 R

[56] References Cited

U.S. PATENT DOCUMENTS

| | | | |
|---|---|---|---|
| 1,587,749 | 6/1926 | Bierly | 272/70 |
| 2,994,890 | 8/1961 | Wagner | 5/475 |
| 3,130,964 | 4/1964 | Johnson | 5/475 X |
| 3,295,847 | 1/1967 | Matt, Sr. | 272/141 |
| 3,310,819 | 3/1967 | Morrison | 5/477 |
| 3,627,313 | 12/1971 | Schonfeld | 272/70 UX |
| 3,638,940 | 2/1972 | Mehaulic | 272/70 UX |
| 3,641,601 | 2/1972 | Sieg | 272/70 UX |
| 3,687,458 | 8/1972 | Proctor, Jr. | 272/68 X |
| 3,741,540 | 6/1973 | Shimizu | 272/141 |
| 3,747,233 | 7/1973 | Berryman | 272/70 X |

*Primary Examiner*—Richard C. Pinkham
*Assistant Examiner*—Arnold W. Kramer
*Attorney, Agent, or Firm*—Allen R. Kipnes

[57] ABSTRACT

An exercising device having at least one platform member and at least two pedals pivotably mounted to one end of each platform member and spaced at the other end from the platform member by springs. For best results, the space between the inclined pedals and the platform member is substantially filled with a crushable, energy-absorbent, resilient material thereby providing cushioned resistance when foot pressure is applied.

5 Claims, 4 Drawing Figures

EXERCISING DEVICE

BACKGROUND OF THE INVENTION

This invention relates to exercising devices and more particularly to portable jogging devices.

Jogging devices which attempt to simulate actual running conditions have been available for some time. Most are large and none, except for treadmill type devices, can simulate actual running conditions. Nonetheless, these so called joggers do tend to stimulate the cardio-vascular system and do tend to permit people to obtain some benefit from their use.

DESCRIPTION OF THE PRIOR ART

But jogging as a sport is not without its problems, not the least of which is the trauma to which legs, ankles and knees may be subjected. Portable jogging devices using treadles typically employ springs located between each of the treadles and a flat surface, such as is shown in U.S. Pat. No. 3,638,847. Other examples are shown in U.S. Pat. Nos. 3,638,940; 3,741,540; 3,814,420; 4,056,265; 3,887,180; and 3,628,791.

Two major disadvantages accompany these prior art spring operated devices. The first relates to the use of a spring. The second relates to the plane in which the spring acts.

Springs must be relatively soft to allow for the treadle to be pushed down. Too large a return force would cause the device to jump when foot pressure on the device is released, also literally pushing the user's foot upward, away from the device when foot pressure is released. Also, too large a spring force would increase the pressure on knees, ankles and legs, forcing the user to work much harder than actual jogging normally requires. But a spring which is soft provides little or no cushioning effect, and may also act to increase the pressure and trauma taken by the user's legs. To understand why, one need only consider the mechanics of the jogging motion. In normal jogging, with sneakers, the jogger's heel contacts the running surface first. As the body rocks forward, weight is transferred from heel to toe and lift-off occurs at the toe. With a jogging device using resilient treadles, the entire foot rests on the treadle surface. When the treadle hits bottom, the shock to the leg is across the entire foot and directly to the joints and leg bones. Where the normal jogging motion tends to transfer this force into a forward component, treadles do not permit this and may, in fact, act to increase the shock to the bones and joints.

In addition, many treadle devices employ a vertical spring although the collapsing action of the treadle is semi-circular, i.e. a point on the treadle will follow a semi-circular path. As a result, the spring force available to resist downward motion increases non-linearly as the treadle is depressed. The jogger tends to stiffen his legs to compensate for the increased force and thus the chance of his hurting a muscle or joint tends to increase.

SUMMARY OF THE INVENTION

In accordance with the present invention, a treadle type jogging device is provided with a base or platform. A space is provided between the treadle and the base or platform. Springs are employed to retain the treadle in a first position ready to receive the user's foot. The springs preferably have a low spring constant to present minimal resistance to the collapse of the treadle to its second position adjacent, or substantially in contact with, the base. The spring constant must, however, be large enough to return the treadle to the first position and the user completes a jogging step by lifting his foot from the jogger.

In the space between treadle and base is placed a crushable material of sponge-like quality, such as a blown urethane, or polyurethane, capable of cushioning and absorbing the impact force of the jogger's downward stroke, and of returning to its original shape when pressure is removed. For best results, enough crushable material is employed to provide cushioning across the entire treadle, thus absorbing much of the unwanted shock to the user's legs, in particular the shock to his bone and joint structure. In this respect, the present invention may be somewhat safer than jogging itself, as more protection is afforded the legs. The jogging device tends to function as a thickly and well padded sneaker would do when coupled with an energy absorbing running surface, such as fine cinder particles covering a sand base running track. And the cushioning action of the crushable material more closely approximates actual running conditions than springs alone.

In the most preferred configuration of the invention, the treadle is hinged at one end to the base, the other end of the treadle being spaced from the base, the treadle and base forming a shape similar to the letter V. One or more coil springs are placed between the treadle and base and spaced from the point at which the two parts are hinged to each other, and a urethane filler is then packed in between the treadle and base and around the coil springs. The device may then be sealed—a bellows type skirt may be placed about the device giving it a neat appearance, or the device may be employed as is, without the skirt—allowing the urethane to fulfill the function of the skirt.

If desired, the coil springs may be placed between treadle and base, so that the axis of the spring is perpendicular to the treadle surface when the treadle is in the up, or first, position. For still better results, the coil spring mounting to the base may permit some movement of the coil spring so that the spring will always remain perpendicular to the treadle. In either case, the increasing force exerted by the spring during compression is more nearly linear than other configurations in which the spring is always vertical. Again, orienting the spring in this fashion tends to allow the device of this invention to more nearly simulate actual jogging conditions than other devices.

Other objects and advantages of the instant invention will become apparent from the detailed description of a preferred embodiment of the invention.

DETAILED DESCRIPTION OF A PREFERRED EMBODIMENT

Referring now to the drawings in which like numerals refer to like parts:

Figure 2:
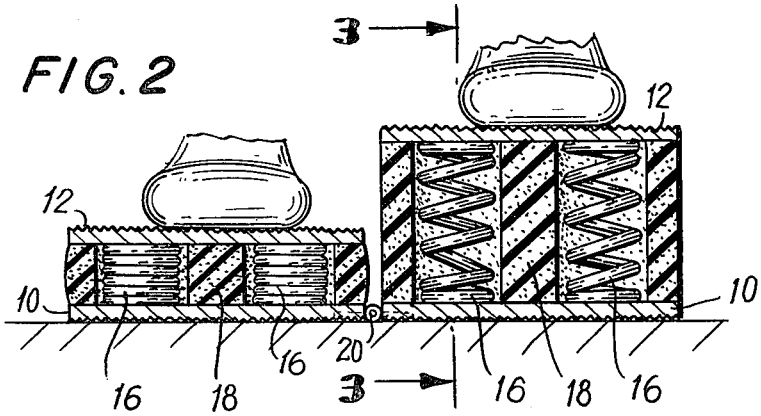
FIG. 2 is a cross-sectional view through line 2—2 of FIG. 1.
Figure 3:
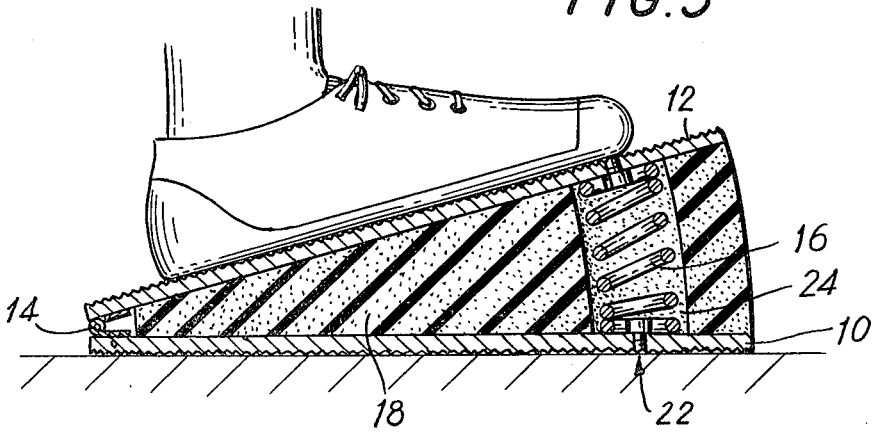
FIG. 3 is a cross-sectional view through line 3—3 of FIG. 2.

Referring particularly to FIGS. 2 and 3, the jogging device comprises a pair of adjacent base members 10 which, as shown, are adapted to lie substantially flat on the floor or other supporting surface. Base members 10 are equipped with a non-skid bottom which may be a liquid latex sprayed on the underside of the base members. Or, if desired, a serrated latex layer may be secured to the bottom of the base member instead by conventional means, such as screws or adhesive (neither shown). The drawings illustrate the use of a serrated member applied to the base. The non-skid surface maximizes traction when the device is in use.

For best results, it is desirable to provide a non-skid surface for treadle 12.

Attached to each base member is a treadle 12, which is hinged at one end thereof by a conventional hinge, such as piano hinge 14, to its cooperating base member 10. A pair of coil springs 16 is mounted between the treadle 12 and its cooperating base member 10, the coil springs serving to normally position the treadle as illustrated in FIG. 3, the treadle and base member in this position assuming the shape of the letter V.

Substantially filling the space between base members 10 and springs 12 is a crushable, resilient material 18, preferably a blown or cellular urethane.

Figure 1:
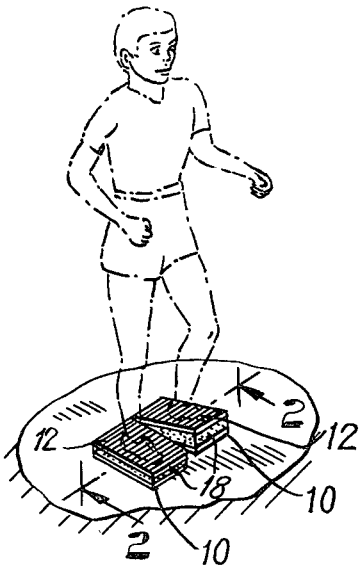
FIG. 1 is a perspective view of the device in use.
Figure 4:
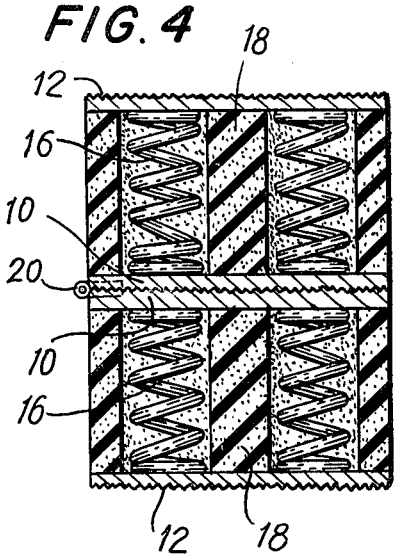
FIG. 4 is a cross-sectional view of the device in folded condition illustrating its compact nature.

FIGS. 1 and 2 illustrate the manner in which the device is used. Referring particularly to FIG. 2, the action imposed on the device by the user shows the right treadle in a first position, springs 16 fully extended, awaiting the user's downward stroke. The treadle on the left has been fully depressed by the user to its second position in which the coil springs 16 are fully compressed, as is the urethane material 18.

In viewing the drawings, it should be understood that the distance through which the treadle moves in traversing its path between the first and second positions can be varied. Shortening the distance simply requires springs with fewer coils. Similarly, lengthening the distance can be achieved by adding coils to the spring.

To illustrate, an acceptable device may employ two coil springs per treadle as shown. The crushable resilient material preferably has a density of 1.2 to 2.0 LBS/ft$^3$.

The jogging device illustrated herein has the base members 10 joined to each other by a conventional piano hinge 20. So joining the base members yields two rather substantial advantages. The first is the ability to use the device without the need to strap the user's feet to the treadle surfaces. The second is the ability to fold the device by rotating the base members about the piano hinge 20, thus providing for rather compact storage of the device. If desired, a strap member (not shown) may be employed to compress the device for still more compact storage.

As illustrated in FIG. 3, the coil springs 16 are fixedly mounted to the base member 10 by conventional means, such as a bolt and clip arrangement denoted by the numeral 22. However, the base member may, if desired, be provided with an inclined abutment shown and denoted by the numeral 24, the surface of the abutment being substantially parallel to the treadle when the treadle is in the first position.

Many modifications may be made to the device described above by those of ordinary skill in the art. It is intended to cover all such modifications which fall within the spirit of the invention as defined by the claims appended hereto.

What is claimed is:

1. An exercising device comprising at least one base and treadle member positioned so as to form a V-shaped opening, hinge means pivotally connecting said base and treadle members at the end remote from said opening, at least one coil spring perpendicularly connected to said treadle member and connected to said base member at a point near said opening so as to conform to the semi-circular contour of the collapsing action of said treadle, and a crushable resilient material substantially filling said opening, said material having an opening with a wall corresponding to the contour formed by said coil spring, said treadle being movable from a first position in which said coil spring is fully extended and said crushable resilient material is substantially uncompressed, and a second position in which both the coil spring and crushable resilient material are compressed and the treadle is pivoted on said hinge toward said base member.

2. The device according to claim 1 wherein said crushable resilient material is polyurethane.

3. The device according to claim 1 in which one of the surfaces of said base member is a non-skid surface.

4. The device according to claim 1 in which one of the surfaces of said treadle is a non-skid surface.

5. The device according to claim 1 further comprising another treadle and another base member, means for pivotally connecting both base members to each other to allow the base members to be folded one on the other.

* * * * *